United States Patent [19]

Sano et al.

[11] Patent Number: 4,471,184

[45] Date of Patent: Sep. 11, 1984

[54] VACUUM INTERRUPTER

[75] Inventors: Takamitsu Sano, Yokohama; Yoshiyuki Kashiwagi, Tokyo; Hifumi Yanagisawa, Sagamihara, all of Japan

[73] Assignee: Kabushiki Kaisha Meidensha, Tokyo, Japan

[21] Appl. No.: 432,380

[22] Filed: Sep. 30, 1982

[30] Foreign Application Priority Data

Oct. 3, 1981 [JP] Japan ..... 56-157847
Oct. 7, 1981 [JP] Japan ..... 56-159903

[51] Int. Cl.[3] ..... H01H 33/00
[52] U.S. Cl. ..... 200/144 B; 252/512
[58] Field of Search ..... 252/512; 200/144 B

[56] References Cited

U.S. PATENT DOCUMENTS

| | | | |
|---|---|---|---|
| 2,154,700 | 4/1939 | Ruben . | |
| 3,372,258 | 3/1968 | Porter | 200/144 B |
| 3,818,163 | 6/1974 | Robinson | 200/144 B |
| 3,821,505 | 6/1974 | Wood . | |
| 3,828,428 | 8/1974 | Wayland . | |
| 3,960,554 | 6/1976 | Gainer, Jr. | 75/200 |
| 4,048,117 | 9/1977 | Emmerich . | |
| 4,293,748 | 10/1981 | Sakuma et al. | 200/144 B |

FOREIGN PATENT DOCUMENTS

| | | |
|---|---|---|
| 2240493 | 3/1974 | Fed. Rep. of Germany . |
| 2522832 | 12/1975 | Fed. Rep. of Germany . |
| 3006275 | 9/1980 | Fed. Rep. of Germany . |
| 2066298 | 7/1981 | United Kingdom . |

*Primary Examiner*—Joseph W. Hartary
*Assistant Examiner*—Morris Ginsburg
*Attorney, Agent, or Firm*—Lowe, King, Price and Becker

[57] ABSTRACT

A vacuum interrupter has a capacity of breaking high voltage and large electric current, and excellent anti-welding characteristics, and prevents generation of harmful surges by current chopping and reignitions, and particularly prevents surges by multi-reignition and three-phase simultaneous breaking caused by the multi-reignition. The vacuum interrupter comprises a pair of electrodes (5*a*, 6*a*) which can close or separate from each other within an electric insulating hermetic vacuum vessel (4), each electrode (5*a*, 6*a*, 15 and 28) is made of a metallic material of a mean vapor pressure, the boiling point of the metallic material being 2700 to 3300K. (2427° to 3027° C.), such as, for example, chromium, or a chromium alloy including a content of more than 90% chromium.

20 Claims, 7 Drawing Figures

VACUUM INTERRUPTER

BACKGROUND OF THE INVENTION

1. Field of the Invention

The present invention relates to a vacuum interrupter, and more specifically to an electrode for the vacuum interrupter, which serves to prevent generation of a switching surge caused by a multi-reignition and a three-phase simultaneous breaking associated with the multi-reignition. (It will, hereinafter, be abbreviated into the three-phase simultaneous breaking.).

2. Description of the Prior Art

Generally, an electrode of a vacuum interrupter (Patent Specifications, for examples, U.S. Pat. Nos. 3,818,163 and 3,960,554) should meet the following conditions;

(1) to have a high static withstanding voltage
(2) to have a large electric current breaking capacity
(3) to have a large electric current flowing capacity
(4) to be easily separable without welding together of the contact surfaces
(5) to withstand the overvoltage caused in the switching surge, and
(6) to have a long electric and mechanical endurance.

Surges by the current chopping and the reignition have been known. However, a research of a switching surge mechanism has been recently developed, which has revealed the fact that the switching surge includes surges caused by multi-reignition and three-phase simultaneous breaking.

Surging caused by multi-reignition is a phenomenon in which ignitions and extinctions of arc are alternated as a result of the competition between the interelectrode dielectric strength recovered by the current breaking operation of a vacuum interrupter and the recovery voltage appearing between the interelectrode immediately after the current breaking, and thus, the interelectrode voltage increases gradually with time.

Such surging is caused in the following cases; (1) high-frequency arc extinction in which the high-frequency (commercial frequency to 1000 kHz, for example 200 kHz) current flowing through the electric circuit is broken at its zero point, (2) in which the current chopping happens in an insufficient arcing time, (3) in which after the contacts are separated prior to a current zero point of commercial frequency current, the arc extinction takes place immediately nearest a current zero point.

The surge by the three-phase simultaneous breaking is a phenomenon in which the multi-reignition caused in one of the three phases of the commercial frequency current causes high-frequency current flowing through the inter-phase impedance to the other two phases, so that the high-frequency current offsets the commercial frequency currnt of the other two phases, consequently a current zero point occurs at least one of the two phases and/or current zero points occur at the two phases, where the three-phase commercial frequency current is interrupted simultaneously at the three phases thereof.

Also, this surge is extremely large as well as that caused by the chopping current larger than the chopping current of the vacuum interrupter, or commercial frequency current at their crest value.

Since electrodes of a vacuum interrupter which are made of metallic contact materials for vacuum interrupters commercially applied at present have, in themselves, no capacity to protect the electric circuit from surges by the multi-reignition and the three-phase simultaneous breaking, a surge suppressor or absorber is provided for protecting the electric circuit within a switchgear comprising a vacuum interrupter.

Therefore, the switchgear of the prior art is large in the size thereof, reliability for protecting the electric circuit of the electric apparatus provided with the switchgear is low, and its manufacturing cost increases. In order to solve such problems, an electrode proper of a vacuum interrupter is desired to prevent surge by the multi-reignition and the three-phase simultaneous breaking.

SUMMARY OF THE INVENTION

The primary object of the present invention is to provide a novel vacuum interrupter of which the electrode proper is able to prevent the harmful surging voltage by the multi-reignition and the three-phase simultaneous breaking without omission of other good characteristics of the electrode required for the vacuum interrupter.

Another object of the present invention is to provide a vacuum interrupter wherein a pair of electrodes is provided in a sealing arrangement within a vacuum vessel, in such a manner that the electrodes are in contact with or separate from each other, and wherein at least one electrode is made of the metallic materials of the mean vapor pressure which have 2700 to 3300K. (2427° to 3027° C.) (Kelvin) boiling points, for example, chromium or chromium base alloy including at least 90% chromium. In accordance with the present invention, since the nature of the electrode materials proper prevents generating of surges by the multi-reignition and the three-phase simultaneous breaking, a switchgear comprising a vacuum interrputer requires no surge absorber and the like therein. Hence, it is possible to reduce the size of the switchgear and its manufacturing cost, and to improve reliability for protecting an electric circuit.

The features and advantages of the vacuum interrupter of the present invention will be more clearly appreciated from the following description taken in conjunction with the accompanying drawings.

DETAILED DESCRIPTION OF THE PREFERRED EMBODIMENTS

Figure 1:
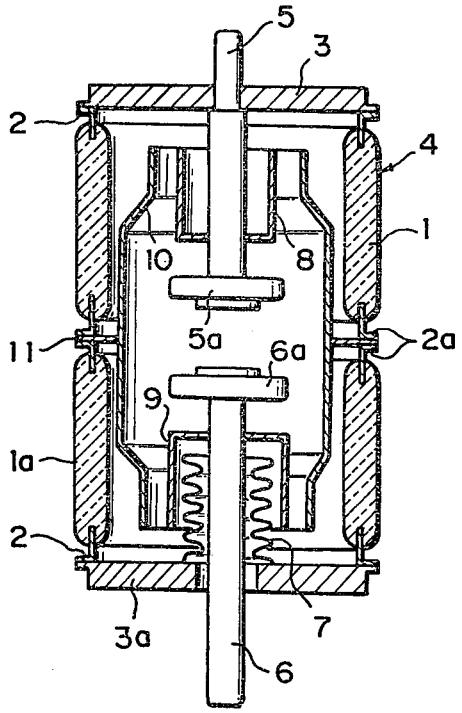
FIG. 1 is a longitudinal cross-sectional view of a vacuum interrupter according to the present invention.

FIG. 1 illustrates a vacuum interrupter comprising two cylindrical insulating housings 1 and 1*a* made of glass or ceramics. Each opening end of the insulating housing 1 or 1*a* is provided with a sealing metallic member 2 or 2*a*. The insulating housings 1 and 1*a* are hermetically connected with each other at the opening ends thereof in such a manner that the sealing metallic members 2a are inserted with a metallic shield supporting member 11 therebetween. Also, the hermetically sealing metallic members 2 are connected hermetically to metallic circular end plates 3 and 3a at opposing opening ends of the housings. The above described elements constitute the highly evacuatable vacuum vessel 4.

A stationary electrode rod 5 is provided hermetically by brazing at the central portion of the end plate 3. A stationary electrode 5a is secured to the inside end of the rod 5 positioned within the vacuum vessel 4. Also, a movable electrode rod 6 is provided hermetically via a bellows 7 at the central portion of the end plate 3a. A movable electrode 6a is secured to the inside end of the rod 6 positioned within the vacuum vessel 4. The movable electrode rod 6 and the end plate 3a are interconnected hermetically by means of the bellows 7 mounted therebetween so that the movable electrode 6a is able to close or open an electrical connection with the stationary electrode 5a.

Within the vacuum vessel 4, an axial shield 8 is provided to the stationary electrode rod 5 preventing an inner surface of the housing 1 from attachment of metallic vapor. A bellow shield 9 is provided to the movable electrode rod 6 concentrically with the outer side of the bellows 7 preventing the bellows outer surface and an inner surface of housing 1a from attachment of metallic vapor. Also, the axial shield 8, the bellows shield 9, and the electrodes 5a and 6a are enclosed within a main shield 10 shaped in form of a substantially circular cylinder. The shield 10 is supported by means of said metallic shield supporting member 11 secured to the center portion on the periphery thereof.

Figure 2:
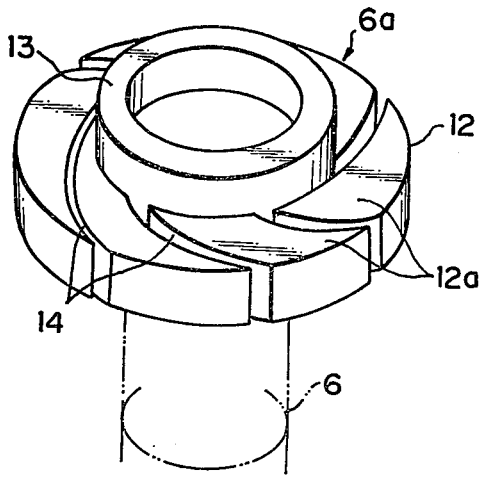
FIG. 2 is an enlarged perspective view of an electrode of FIG. 1.

The stationary or movable electrode 5a or 6a, of the so-called inductive magnetic driving type shown in FIG. 2, comprises a disk-shaped arc electrode 12 and a ring or button-shaped contact 13 projected at the central portion of the surface of the arc electrode 12.

The arc electrode 12 has a diameter properly larger than that of the electrode rod 5 or 6, and also, is divided by means of a plurality of slits 14 into a plurality of fingers 12a. The slits 14 penetrate the arc electrode 12 axially (vertically in FIG. 2) and an arc, formed when contacts 13, 13 are opened, is driven outwardly from contacts 13, 13 to the arc electrodes 12, 12 under the lateral magnetic field effected by current flowing through each contact 13, and in turn along the slits 14 to the periphery of the arc electrodes 12, 12.

At least one of the contacts 13—13 of the electrodes 5a and 6a is made of a metallic material of mean vapor pressure, the boiling points of said materials being 2700 to 3300K. (2427° to 3027° C.), while at least one of the arc electrodes 12 of the electrodes 5a and 6a is made of a metallic material which easily transfers the arc between the contacts 13, 13 to the finger 12a of each arc electrode 12 and which is of substantially similar or slightly higher vapor pressure than that of the contact 13. As a metallic material of mean vapor pressure made of the contact 13, chromium, chromium alloy including less than 10% copper, or chromium alloy including less than 10% silver is employed. For the arc electrode 12, a metallic material such as chromium, chromium alloy including less than 10% copper, chromium alloy including less than 10% silver, copper, iron, iron alloy, for example, stainless steel, or iron alloy including copper or silver may be used.

Such chromium alloy may be produced in such a manner that metal powders of chromium, and copper or silver are sintered together in a vacuum or in an inert gas. Alternatively, it may be produced in such a manner that chromium powder is sintered into a porous chromium matrix in which copper or silver having a lower melting point than that of chromium is infiltrated.

Iron alloy including copper or silver may be produced by sintering together metal powders of copper or silver, and stainless steel in a vacuum.

Also, the iron alloy may be produced in such a manner that iron powder is sintered into a porous iron matrix in which copper or silver is infiltrated. The results of tests conducted on electrode materials as described above were as follows in Table 1 below.

TABLE 1

| test item | characteristic tests for electrode materials — electrode material: iron | stainless steel | chromium | titanium | copper | copper-alloy tungsten |
|---|---|---|---|---|---|---|
| chopping current value [A] | 4–5.5 | 4–5 | 3–4.5 | 6–8 | 10–15 | 4–5 |
| 200 kHz high-frequency breaking current value [kA crest] | 150–250 | 100–230 | 150–250 | — | 700–1000 | 140–200 |
| 50 Hz commercial frequency breaking current value [kA crest] | 12–16 | 12–15 | 15–20 | 10–14 | 15–20 | 5–9 |
| impulse withstand voltage [kV] | 130–150 | 130–150 | 110–140 | 130–160 | 120–150 | 120–140 |
| anti-welding characteristics | X | X | O | X | Δ | O |
| contact resistance (140 Kg pressurized) [μΩ] | 75–110 | 150–250 | 50–80 | 200–300 | 10–15 | 30–50 |

O - good
Δ- intermediate
X - poor (Remark: Each value is a mean of three test pieces. Especially, each contact electric resistance includes that of each electrode rod.)

As apparent from the above Table 1, iron and iron alloy, for example stainless steel, have a lower chopping value compared with another material, for example titanium or copper. Moreover, iron and iron alloys are characterized by an ordinary commercial frequency breaking current value, a lower high-frequency breaking current value compared with copper, poor anti-welding characteristics, and a larger contact electric resistance than chromium or copper. The iron and iron alloy above-mentioned are, therefore, not suitable as a metallic material for the contact 13.

Also, as apparent from the Table 1, chromium has good characteristics for an electrode material, especially, a metallic material for the contact 13, but a high-frequency breaking current value which is not as large as copper.

Next, arc transferability tests were performed on various combinations of metallic materials for the contact 13 and arc electrode 12. The results of the tests were as follows in Table 2.

TABLE 2

| | tests for the arc transferability | | | | |
|---|---|---|---|---|---|
| | contact material | | | | |
| arc electrode material | copper | iron | stainless steel | copper tungsten alloy | chromium |
| copper | O | Δ | Δ | X | O |
| iron | O | O | O | X | O |
| stainless steel | O | O | O | X | O |
| copper-tungsten alloy | Δ | X | X | Δ | Δ |
| chromium | O | O | O | X | O |

O . . . good
Δ . . . intermediate
X . . . poor

As apparent from the Table 2, variation of a combination of metallic materials for the contact 13 or the arc electrode 12 varies the arc transferability.

Subsequent to the characteristic tests on various metallic materials of an electrode material as above-mentioned, a switching surge test was performed on a vacuum interrupter comprising electrode assemblies of the above various metallic materials, under a reactor load.

The switching surge test disclosed the fact that when iron, stainless steel, chromium, and chromium alloy including no more than 20% copper or silver were employed as a metallic material for the contact 13, harmful surge voltage was not caused, since accidental occurrence of reignition did not cause multi-reignition and three-phase simultaneous breaking. However, when the chromium alloy included copper or silver within the range of 10% to 20%, the alloy had poor anti-welding characteristics, and increased chopping current i.e. chopping surge voltage.

Consequently, it was found, from the results of the switching surge tests, and the Tables 1 and 2, that chromium, or chromium alloy including less than 10% copper or silver was adapted to constitute the contact 13, which caused no surges by the multi-reignition and by the three-phase simultaneous breaking, and satisfied the above-mentioned requirements for an electrode of the vacuum interrupter.

Also, it was found, from the results of the switching surge test, and the Tables 1 and 2, that metallic material which had substantially the same, or slightly higher vapor pressure than that of the metallic material for the contact 13, and good transferability of arc between the contacts 13, 13 to the arc electrode 12 was most preferable for use as the material for the arc electrode 12 in relation to the above-mentioned material for the contact 13. The metallic material which has a slightly higher vapor pressure than that of the material for the contact 13 might be a copper alloy, an iron alloy such as iron and stainless steel, which did not include the metallic material of the low vapor pressure, for example, molybdenum or tungsten to the large extent of the low vapor pressure material.

Figure 3:
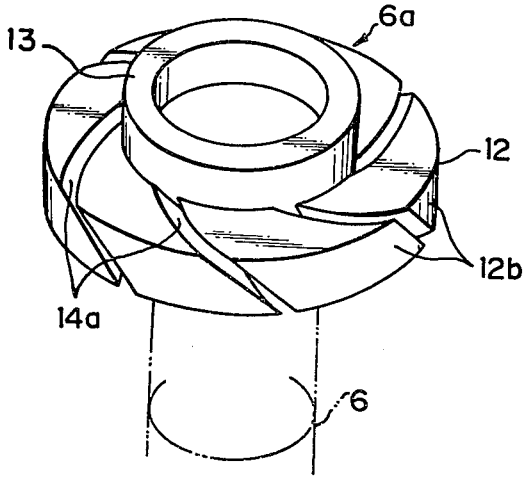
FIG. 3 is an enlarged perspective view of another embodiment of the electrode by the present invention.

FIG. 3 illustrates another embodiment of an arc electrode, which is divided by a plurality of slits 14*a* into a plurality of fingers 12*b*. The slits 14*a* extend through a thickness of the arc electrode 12, inclined to the axis and radius of the arc electrode 12, so that the adjacent fingers 12*b* are positioned above one another in the axial direction of the arc electrode 12.

Now, another embodiment of the vacuum interrupter of the present invention will be described with reference to FIG. 4. Such embodiment is provided with a pair of electrode assemblies comprising a coil electrode producing a longitudinal magnetic field parallel to the interelectrode arc. The same reference numerals refer to the same portions of the embodiment as those of FIG. 1. The present vacuum interrupter comprises a disk-shaped electrode 15 which is provided via a high electric resistance spacer 22 (shown in FIG. 6) at the inside ends of electrode rods 5 and 6 respectively. Longitudinal magnetic field generating coil electrode 27, which has substantially the same diameter to that of the electrode 15, is mounted respectively on the electrode rods 5 and 6 behind the electrode 15. Each coil electrode 27 converts longitudinal electric current (vertically in FIG. 4) flowing in each electrode rod 5 or 6 into loop current along a periphery in the backside of each electrode 15 to generate the longitudinal magnetic field parallel to the arc. Thus, the vacuum interrupter of FIG. 4 has capacity to interrupt large electric current.

Figure 5:
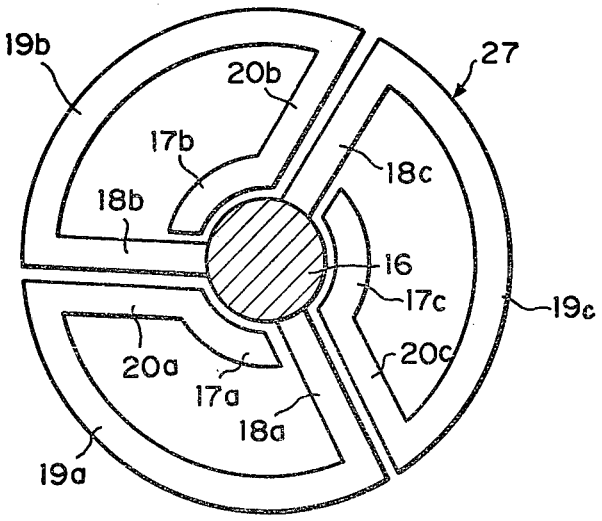
FIG. 5 is a plan view of a coil electrode of FIG. 4.
Figure 6:
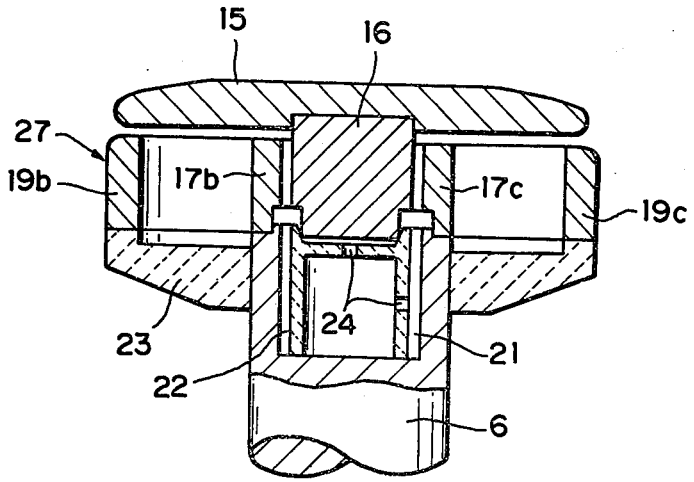
FIG. 6 is a longitudinal cross-sectional view of an electrode assembly of FIG. 4.

A $\frac{1}{3}$ turn type of the longitudinal magnetic field generating coil electrode 27 is illustrated in FIGS. 5 and 6. The $\frac{1}{3}$ turn type coil electrode 27 comprises a columnar central conductor 16 having a smaller diameter than that of the electrode rod 6, three first circular-arc-shaped coil sections 17*a*, 17*b* and 17*c* positioned concentrically around the central conductor 16, three first arm sections 18*a*, 18*b* and 18*c* extending outwardly from trisections of the periphery of the central conductor 16 through each space of the first coil sections 17*a*, 17*b* and 17*c*, three second circular-arc-shaped coil sections 19*a*, 19*b* and 19*c* extending from the ends of the first arms 18*a*, 18*b* and 18*c* concentrically to the first coil sections 17*a*, 17*b* and 17*c*, and three second arm sections 20*a*, 20*b* and 20*c* extending in parallel, respectively, to the three first arm sections 18*b*, 18*c* and 18*a* in the identified plane, and interconnecting respectively the second coil sections 19*a*, 19*b* and 19*c* to the first coil sections 17*a*, 17*b* and 17*c*. The coil electrode 27 is connected electrically and mechanically to the electrode rod 6 at the first coil sections 17*a*, 17*b* and 17*c*, and electrically and mechanically to the electrode 15 at the central conductor 16. The second coil sections 19*a*, 19*b* and 19*c* of the coil electrode 27 are supported by means of a ceramics or high electric resistance metallic disk-shaped coil electrode support 23 mounted on the electrode rod 6. The central conductor 16 is mechanically connected to the electrode rod 6, via a ceramics or high electric resistance metallic hollow cylindrical spacer 22. The electric resistance spacer 22 is positioned in a bore 21 defined at the inside end of the electrode rod 6. A gas exhausting hole is indicated at a numeral 24 in FIG. 6.

The hole 24 is provided for brazing the electric resistance spacer 22 to the electrode rod 6.

The electrode 15 of FIG. 6 is made of the same material to that of the contact 13 of FIGS. 1 to 3.

Figure 7:
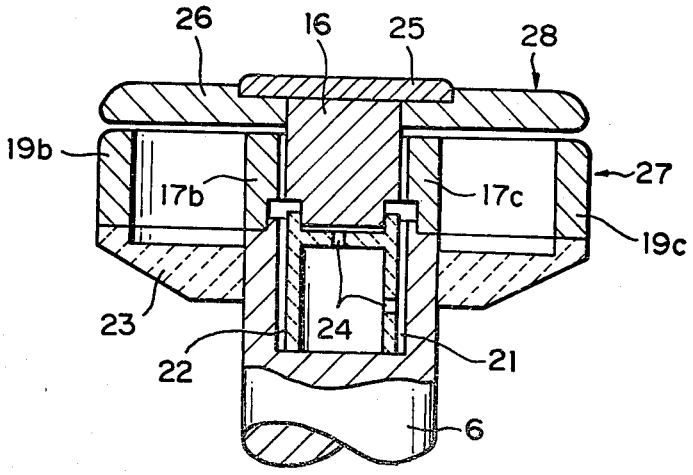
FIG. 7 is a longitudinal cross-sectional view of another embodiment of the electrode assembly of FIG. 4.

FIG. 7 illustrates another embodiment of the electrode 15 of FIG. 6 in which a circular-plate-shaped contact 25 is connected to a disk shaped arc electrode 26 by brazing and projected from the central opening of the disk shaped arc electrode 26. The contact 25 is made of the same metallic material as the contact 13 of FIGS. 1 to 3, and is electrically and mechanically connected to the central conductor 16 by brazing through a thickness of the arc electrode 26. The arc electrode 26 is made of the same metallic material as the arc electrode 12 of FIGS. 1 to 3. The electrode 28 in the embodiment of FIG. 7 can perform the electric arc breaking by means of the contacts 25 within the small electric current range, while, within the large electric current range the electrode is arranged, in such a manner that the magnetic field generated by the coil electrode 27 scatters the arc on the surface of the arc electrode 26.

Figure 4:
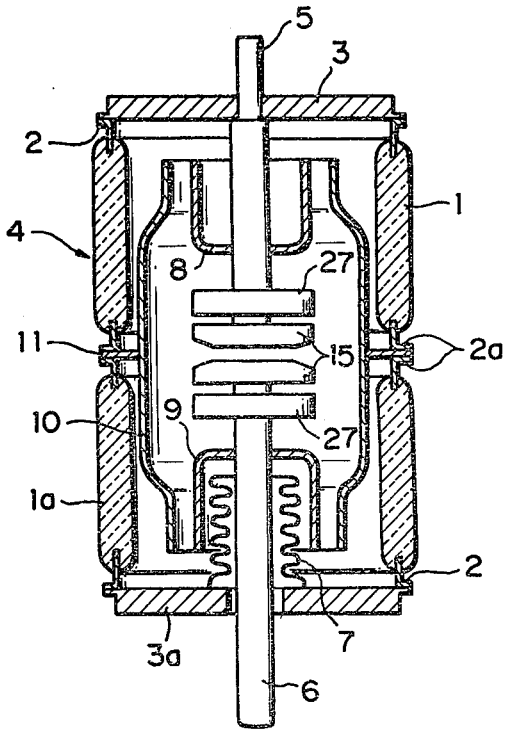
FIG. 4 is a longitudinal cross-sectional view of another embodiment of a vacuum interrupter by the present invention.

The results of the characteristic tests on the vacuum interrupter of FIG. 4 are the same as those listed on the Tables 1 and 2.

Although there have been illustrated and described specific structures, it is to be clearly understood that the same were merely for the purpose of illustration, and that changes and modifications may readily be made therein by those skilled in the art, without departing from the spirit and scope of the invention.

What is claimed is:

1. A vacuum interrupter comprising a pair of electrodes at least one of which comprises a contact electrode and a longitudinal magnetic field generating coil electrode provided behind the contact electrode to generate a magnetic field parallel to an electric arc between said electrodes, and means for closing and opening said electrodes within an electric insulating hermetic vacuum vessel, wherein said at least one contact electrode is made of a material comprising at least 90% chromium.

2. The vacuum interrupter of claim 1 wherein said material is comprised substantially of chromium.

3. The vacuum interrupter of claim 1 wherein said material is comprised of a chromium alloy including at least 90% chromium.

4. The vacuum interrupter of claim 3, wherein said material comprises a chromium alloy including less than 10% copper.

5. The vacuum interrupter of claim 3, wherein said material comprises a chromium alloy including less than 10% silver.

6. The vacuum interrupter of claim 1 wherein said magnetic field generating coil electrode is formed with a diameter substantially equal to a diameter of said contact electrode, said contact electrode and said magnetic field generating coil electrode being mounted on an electrode rod within said vessel, said magnetic field generating coil electrode comprising means for generating said magnetic field substantially longitudinally with respect to said pair of electrodes.

7. The vacuum interrupter of claim 6 wherein said means for generating comprises means for converting longitudinal current flowing in said electrode rod to a loop current along a peripheral area behind said contact electrode to generate said magnetic field.

8. The vacuum interrupter of claim 7 wherein said means for converting comprises a one-third turn type coil structure.

9. The vacuum interrupter of claim 7 wherein said means for converting comprises at least one loop having first and second arm sections extending radially from a central conductor electrically connected to said contact electrode and mounted on and insulated from said rod, said first arm section connecting said central conductor, and first and second arc-shaped coil sections, said second coil section connecting said first and second arm sections, said first coil section connected to said second arm section and spaced apart from said central conductor and from said first arm section.

10. The vacuum interrupter of claim 9 wherein said first and second coil sections are substantially coaxial with said central conductor and with said rod.

11. A vacuum interrupter comprising:

an electrically insulating vacuum vessel;

a pair of electrodes provided within the vessel, each electrode having a separable contact portion, wherein at least one of the contact portions is made of a metal selected from a group consisting of chromium and sintered chromium alloy, which alloy includes more than 90% chromium alloyed with another metal which has a melting point lower than that of chromium selected from a group consisting of copper and silver.

12. The vacuum interrupter of claim 11, wherein each electrode includes an arc-electrode surrounding the contact portion thereof, said arc-electrode held separated from an arc-electrode of the other electrode.

13. The vacuum interrupter of claim 11, wherein the sintered chromium alloy is made of chromium powder and another metal powder selected from the group consisting of copper and silver.

14. The vacuum interrupter of claim 11, wherein the sintered chromium alloy consists of a porous matrix of chromium to which chromium powder is sintered and copper with which the matrix is infiltrated.

15. The vacuum interrupter of claim 11, wherein the sintered chromium alloy consists of a porous matrix of chromium to which chromium powder is sintered and silver with which the matrix is infiltrated.

16. The vacuum interrupter of claim 12, wherein each electrode includes means for inducing magnetic field to turn off an electric arc established between the electrodes.

17. The vacuum interrupter of claim 12, wherein each electrode includes behind each contact portion a longitudinal magnetic field generating coil electrode which creates a magnetic field parallel to an electric arc established between said electrodes.

18. The vacuum interrupter of claim 12, wherein each electrode further comprises circular plate contact means connected to said arc electrode and projecting from a central opening provided in the arc electrode, said circular plate contact means being brazed to said arc electrode.

19. The vacuum interrupter of claim 12, wherein said arc electrode is made of a metallic material having a vapor pressure slightly higher than said metal forming said contact portion.

20. The vacuum interrupter of claim 19, wherein said arc electrode is made of a metal selected from the group consisting essentially of chromium, chromium alloy including more than 90% chromium, copper, iron and iron alloy.

* * * * *